United States Patent [19]

Tuckett et al.

[11] 4,422,678

[45] Dec. 27, 1983

[54] LATCH

[76] Inventors: Larry L. Tuckett, 1890 N. Fruitland Dr.; Ronald L. Kendall, 1734 N. Fruitland Dr., both of North Ogden, Utah 84404

[21] Appl. No.: 234,737

[22] Filed: Feb. 17, 1981

[51] Int. Cl.[3] ..... E05C 17/36

[52] U.S. Cl. ..... 292/264; 292/246

[58] Field of Search ..... 292/264, 246, 300

[56] References Cited

U.S. PATENT DOCUMENTS

| | | | |
|---|---|---|---|
| 880,214 | 2/1908 | Henninges | 292/264 |
| 2,726,112 | 12/1955 | Conhagen | 292/264 |
| 2,790,663 | 4/1957 | Sarver | 292/264 |
| 2,805,093 | 9/1957 | Van Den Thoorn | 292/264 |
| 3,720,431 | 3/1973 | Oliver et al. | 292/264 |
| 3,738,694 | 6/1973 | Banse | 292/264 |

FOREIGN PATENT DOCUMENTS

| | | | |
|---|---|---|---|
| 1155157 | 6/1969 | United Kingdom | 292/264 |

*Primary Examiner*—Richard E. Moore

*Attorney, Agent, or Firm*—B. Deon Criddle

[57] ABSTRACT

A simple, easily-installed, and economical latch. The latch comprises a connector brace and means for affixing said brace onto a door frame, farm gate-post, vehicle frame, animal halter, or the like. The latch further comprises a rigid loop projecting out perpendicular from the top of the brace, a chain or cord attaching at one end to the loop, and a tongue member extending up from the bottom of the brace and passing a short distance through the loop. When used with the chain, the desired connection is secured by slipping a link on the free end of the chain up through the loop and down over the tongue member.

1 Claim, 6 Drawing Figures

LATCH

BACKGROUND OF THE INVENTION

1. Field of the Invention

This invention relates to latch devices and systems.

2. Description of the Prior Art

In the past, latch systems have commonly relied on specially-shaped slots designed for reception of either a sliding bolt member or a link in a section of link chain. The familiar chain door latch, for example, requires use of both a sliding bolt member attached to the end of a link chain and a specially-designed slot piece. Similarly, U.S. Pat. Nos. 3,720,431 and 3,738,694 each disclose a latch having specially-cut slots unlike the more simple tongue and loop construction of the present invention. Other systems such as are disclosed in U.S. Pat. Nos. 464,079, 880,214 and 2,790,663, while utilizing a tongue member to receive a link of a section of chain, do not include a loop forming a part of the present invention, which loop serves not only to secure one end of the chain but also prevents undesired slippage of the link off of the tongue member.

SUMMARY OF THE INVENTION

A principal object of the present invention is to provide a simple economical and easily installed latch device.

A further object is to provide a latch system which may be readily adapted for a wide variety of uses.

Important features of the invention include a connector brace and means for affixing said brace onto a door frame, post, vehicle frame or the like.

Other features comprise a rigid metal loop projecting out perpendicular from the top of the brace, a chain or cord fixed at one end with respect to the loop, and a tongue member extending up from the bottom of the brace and passing a short distance up through the loop.

Additional features and objects of the invention will become apparent from the following detailed description taken together with the drawings.

DRAWINGS

DETAILED DESCRIPTION

1. Referring now to the drawings

Figure 1:
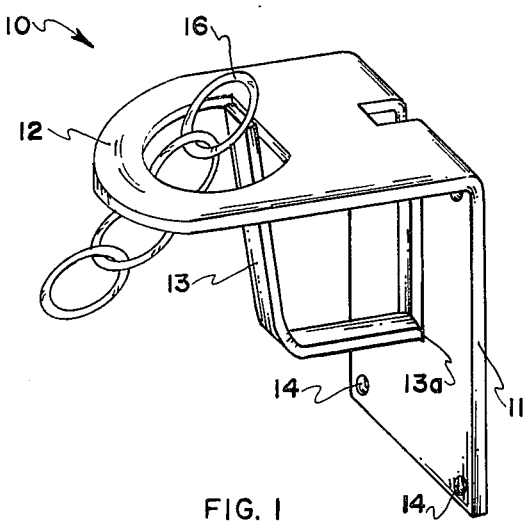
FIG. 1 is a perspective view of the preferred embodiment of the latch device of the present invention.
Figure 2:
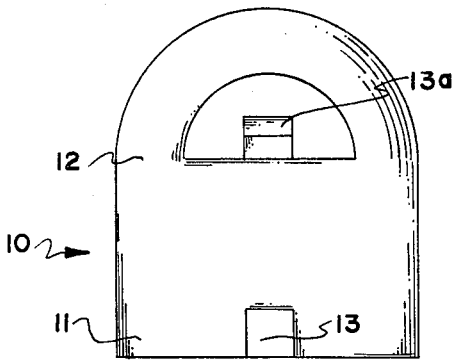
FIG. 2 is a top plan view of the preferred embodiment of the invention.
Figure 3:
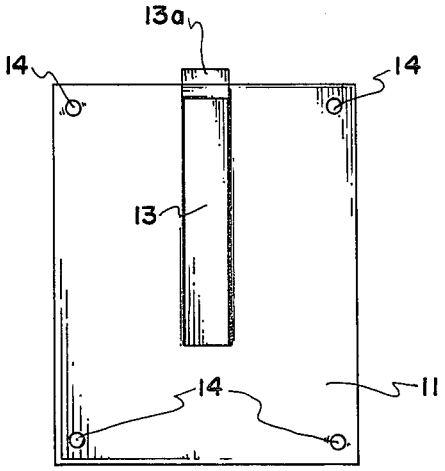
FIG. 3 is a rear elevation view of the preferred embodiment of the invention.
Figure 4:
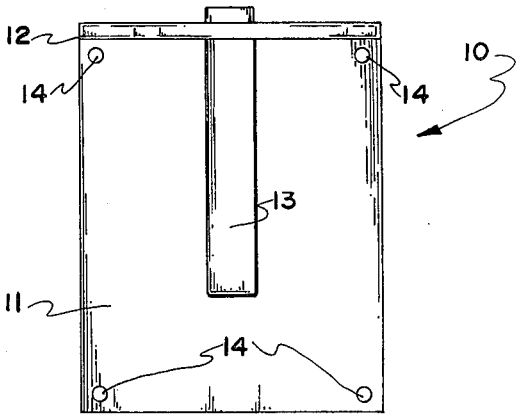
FIG. 4 is a front elevation view of the preferred embodiment of the invention.

FIGS. 1–4 provide different views of a one-piece, stamped, bent and reinforcement welded unit that is very economical to produce. As shown in FIG. 1, the latch device 10 comprises a connector brace 11, a rigid metal loop 12, and a tongue member 13.

In the embodiment of FIGS. 1–4, both the loop 12 and tongue member 13 are formed from a single piece of metal. The latch device 10 is then readily produced by bending the tongue member 13 into the desired position and the loop 12 into a position perpendicular to the connector brace 11. A hook portion 13*a* of the tongue member 13 extends a short distance up through the loop 12 and the tongue preferably has a reinforcement weld 13*a* at the point of attachment to the connector brace 11. Several openings 14 are provided in the connector brace 11 for screws, bolts or other fasteners. The latch device 10 is used with a chain 15, FIG. 5, and the desired latching connection is secured by slipping a link 16 on the free end of the chain up through the loop 12 and down over the hook portion 13*a* of the tongue member 13. The other end of the chain 15 may be attached to the device 10 so that the chain may be wrapped around an object to be held before link 16 is placed over tongue member 13. Alternatively, the other end of the chain may be fixed to an independent structure to be attached to the device 10. For example, the latch device 10 may be attached to a gate post or a door frame and a chain attached to a gate or to a door can be attached to the device 10 in the manner disclosed.

Figure 5:
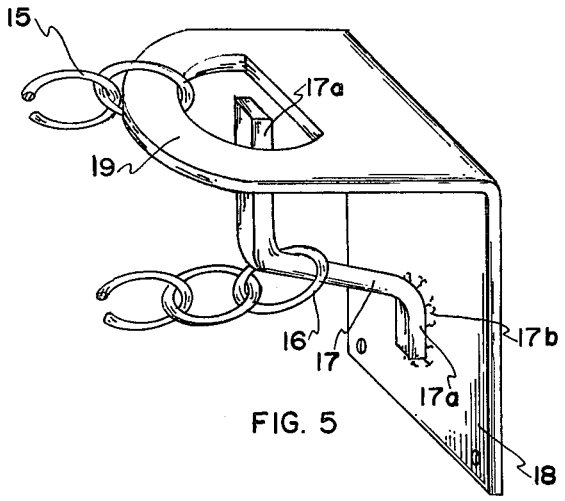
FIG. 5 is a perspective view of a second embodiment of the invention.

In the embodiment, shown in FIG. 5, the tongue member, here shown at 17, is formed separately from the rest of the latch device. As shown, a welding surface is provided by a foot 17*a* that extends from the tongue member 17. The foot 17*a* is then welded at 17*b* to the connector brace 18 such that the free end of the tongue member 17 will extend as a hook centrally through the loop 19, which is preferably formed integrally with the brace 18, but which could also be formed separately and be welded to the brace.

As shown in FIG. 5, a chain 20 has a free end link end 20*a* that can be inserted upwardly through loop 19 and then be dropped over the hook 17*a*. The other end of chain 20 may be fixed to an object to be secured to hook 17*a* or may be attached either to brace 18 or loop 19 so that the chain can be wrapped around or passed through an object to be secured to hook 17*a*.

Figure 6:
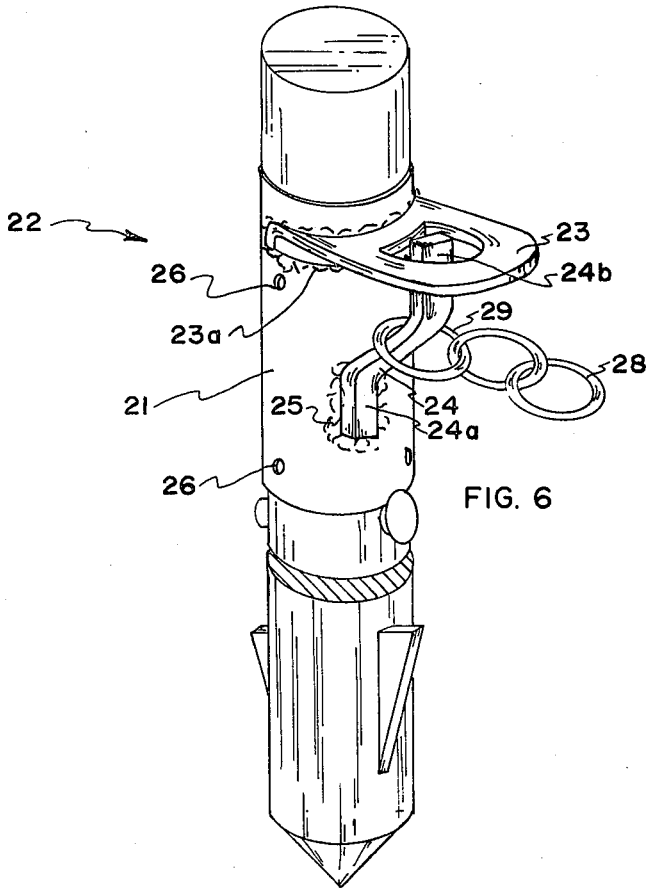
FIG. 6 is a perspective view of a third embodiment of the invention, particularly useful with a gate post or animal stake-out.

The embodiment of latch device shown in FIG. 6 may incorporate either of the two tongue member embodiments previously described. In this embodiment, a sleeve 21 serves as a connector brace for the latch device shown generally at 22. In use, the tubular sleeve may be telescoped into place over a stake, gate-post, stanchion, or the like, so that the desired chain connection can be made. The latch device 22 includes a loop 23, welded at 23*a* to the tubular connector brace 21 and a tongue member 24 having one end 24*a* welded at 25 to the tubular connector brace and its other end 24*b* extending as a hook through the central portion of the loop 22.

Holes 26 are provided through the tubular connector brace to permit nails, screws, bolts, or the like to be inserted and to lock the tubular connector brace against rotation on the post or stanchion on which it is telescoped, should this be desired. For example, it may be desirous to fix the position of the connector brace on its supporting structure if the supporting structure is a gate post, but may be left free to rotate when the supporting structure is an animal tethering post. In either event, a chain 28 has a leading link 29 that can be inserted upwardly through loop 23 before being dropped over the hook 24*b*.

It will be apparent that the connector brace of the invention can be shaped as necessary to adapt it to various uses.

Although preferred forms of our invention have been herein disclosed, it is to be understood that the present disclosure is by way of example and that variations are possible without departing from the subject matter coming within the scope of the following claims, which subject matter we regard as our invention.

We claim:

1. A latch device comprising a connector brace having one end forming an attachment member and another end bent to extend normal to said attachment member and forming a rigid loop;

a tongue member formed by bending a piece of said attachment member and the other end of said connector brace to extend from said attachment member and including a hook extending parrallel to said attachment member and through a central portion of said loop.

* * * * *